US010054895B2

(12) United States Patent
Nakagaki

(10) Patent No.: US 10,054,895 B2
(45) Date of Patent: Aug. 21, 2018

(54) IMAGE FORMING APPARATUS AND IMAGE FORMING METHOD

(71) Applicant: Toshihiro Nakagaki, Kanagawa (JP)

(72) Inventor: Toshihiro Nakagaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/132,681

(22) Filed: Apr. 19, 2016

(65) Prior Publication Data

US 2016/0334750 A1 Nov. 17, 2016

(30) Foreign Application Priority Data

May 14, 2015 (JP) ..... 2015-099240
Oct. 2, 2015 (JP) ..... 2015-196593

(51) Int. Cl.
*G03G 15/00* (2006.01)

(52) U.S. Cl.
CPC ..... *G03G 15/70* (2013.01); *G03G 15/657* (2013.01)

(58) Field of Classification Search
CPC ..... G03G 15/70
USPC ..... 399/21
See application file for complete search history.

(56) References Cited

U.S. PATENT DOCUMENTS 5,502,545 A * 3/1996 Tsuruoka ..... G03G 15/0131 399/21
5,909,604 A * 6/1999 Arai ..... G03G 21/12 399/35
7,720,398 B2 * 5/2010 Fukui ..... G03G 15/6573 399/21
8,905,401 B2 12/2014 Nakagaki
9,096,398 B2 8/2015 Nakagaki
2007/0025748 A1 * 2/2007 Ishibashi ..... G03G 15/5033 399/49
2009/0304398 A1 * 12/2009 Shimizu ..... G03G 15/2028 399/21
2010/0061752 A1 * 3/2010 Sudo ..... G03G 15/0131 399/66

(Continued)

FOREIGN PATENT DOCUMENTS

JP 2008-100831 5/2008
JP 2010-008730 1/2010

(Continued)

*Primary Examiner* — Anthony Nguyen
(74) *Attorney, Agent, or Firm* — Harness, Dickey & Pierce, P.L.C.

(57) ABSTRACT

An image forming apparatus includes an intermediate transfer body; an image formation unit, configured to form a toner image on the intermediate transfer body; a transfer unit, arranged opposite the intermediate transfer body, configured to transfer the toner image onto a recording medium at a secondary transfer position; a first cleaning unit configured to collect toner of the toner image; a conveyance unit configured to convey the recording medium along a conveyance path; a jam detection unit configured to detect a jam of the recording medium conveyed on the conveyance path; a jam processing unit configured to transfer residual toner, which is not transferred onto the recording medium when the jam is detected by the jam detection unit, from the intermediate transfer body to the transfer unit; and a second cleaning unit configured to collect the residual toner on the transfer unit.

16 Claims, 9 Drawing Sheets

(56) References Cited

U.S. PATENT DOCUMENTS

| | | | | |
|---|---|---|---|---|
| 2010/0187746 | A1* | 7/2010 | Hirata | B65H 7/12 271/3.16 |
| 2011/0210502 | A1* | 9/2011 | Fujita | B65H 5/062 271/258.01 |
| 2012/0155899 | A1* | 6/2012 | Watanabe | G03G 15/5058 399/49 |
| 2012/0155902 | A1* | 6/2012 | Torimaru | G03G 15/657 399/66 |
| 2013/0094867 | A1* | 4/2013 | Arai | G03G 15/70 399/21 |
| 2013/0193637 | A1* | 8/2013 | Taguchi | G03G 15/6544 271/207 |
| 2013/0287413 | A1* | 10/2013 | Akamatsu | G03G 15/2085 399/21 |
| 2014/0327207 | A1* | 11/2014 | Nakagaki | B65H 7/125 271/262 |

FOREIGN PATENT DOCUMENTS

| | | |
|---|---|---|
| JP | 2010-145782 | 7/2010 |
| JP | 2010-152198 | 7/2010 |
| JP | 2010-152202 | 7/2010 |
| JP | 2010-210662 | 9/2010 |
| JP | 4909206 | 4/2012 |
| JP | 2013-249171 | 12/2013 |
| JP | 2014-043338 | 3/2014 |

* cited by examiner

IMAGE FORMING APPARATUS AND IMAGE FORMING METHOD

CROSS-REFERENCE TO RELATED APPLICATIONS

The present application claims benefit of priority under 35 U.S.C. § 119 of Japanese Patent Applications No. 2015-099240, filed May 14, 2015, and No. 2015-196593 filed Oct. 2, 2015. The contents of these applications are incorporated herein by reference in their entirety.

BACKGROUND OF THE INVENTION

1. Field of the Invention

The disclosures herein generally relate to an image forming apparatus and an image forming method.

2. Description of the Related Art

Conventional electrophotographic image forming apparatuses generally include an intermediate transfer belt. A toner image formed on a photoreceptor is first transferred to the intermediate transfer belt and then the image is transferred from the intermediate transfer belt to a recording medium.

Jam processing methods have been proposed for conveying a recording medium present in the image forming apparatus having the above-described configuration to a jam processing position without subsequently transferring a toner image formed on the intermediate transfer belt, when a jam occurs (e.g. see Japanese Patent No. 4909206). Because recording media are gathered as blank sheets on which toner images have not been transferred when a jam occurs, a user can perform a jam processing without get his/her hands dirty from the toner on the recording medium.

SUMMARY OF THE INVENTION

It is a general object of at least one embodiment of the present invention to provide an image forming apparatus and an image forming method that substantially obviate one or more problems caused by the limitations and disadvantages of the related art.

In one embodiment, an image forming apparatus includes an intermediate transfer body; an image formation unit, configured to form a toner image on the intermediate transfer body; a transfer unit, arranged opposite the intermediate transfer body, configured to transfer the toner image onto a recording medium at a secondary transfer position provided between the intermediate transfer body and the transfer unit; a first cleaning unit configured to collect toner of the toner image formed by the image formation unit on the intermediate transfer body; a conveyance unit configured to convey the recording medium along a conveyance path; a jam detection unit configured to detect a jam of the recording medium conveyed on the conveyance path; a jam processing unit configured to transfer residual toner, which is not transferred onto the recording medium when the jam is detected by the jam detection unit, from the intermediate transfer body to the transfer unit; and a second cleaning unit configured to collect the residual toner on the transfer unit that is transferred by the jam processing unit from the intermediate transfer body.

In another embodiment, an image forming apparatus includes an intermediate transfer body; an image formation unit, configured to form a toner image on the intermediate transfer body; a transfer unit, arranged opposite the intermediate transfer body, configured to transfer the toner image onto a recording medium at a secondary transfer position that is between the intermediate transfer body and the transfer unit; a cleaning unit configured to collect toner of the toner image formed by the image formation unit on the intermediate transfer body; a conveyance unit configured to convey the recording medium along a conveyance path; a jam detection unit configured to detect a jam of the recording medium conveyed on the conveyance path; and a jam processing unit configured to transfer residual toner, which is not transferred onto the recording medium when the jam is detected by the jam detection unit, from the intermediate transfer body onto the recording medium. In a case where an image area ratio of the residual toner is less than a predetermined value, the jam processing unit is configured to cause the transfer unit to transfer the residual toner onto the recording medium at a first transfer rate. In a case where the image area ratio of the residual toner is greater than or equal to the predetermined value, the jam processing unit is configured to cause the transfer unit to transfer the residual toner onto the recording medium at a second transfer rate, which is less than the first transfer rate.

In yet another embodiment, an image forming method for forming an image on a recording medium includes detecting a jam of the recording medium conveyed on a conveyance path; transferring residual toner, which is not transferred onto the recording medium when the jam is detected, from an intermediate transfer body, on which a toner image is formed, to a transfer unit, which is arranged opposite the intermediate transfer body and is configured to transfer the toner image onto the recording medium; and collecting the residual toner, which is transferred to the transfer unit.

BRIEF DESCRIPTION OF THE DRAWINGS

Other objects and further features of embodiments will become apparent from the following detailed description when read in conjunction with the accompanying drawings, in which.

DESCRIPTION OF THE PREFERRED EMBODIMENTS

Figure 1:
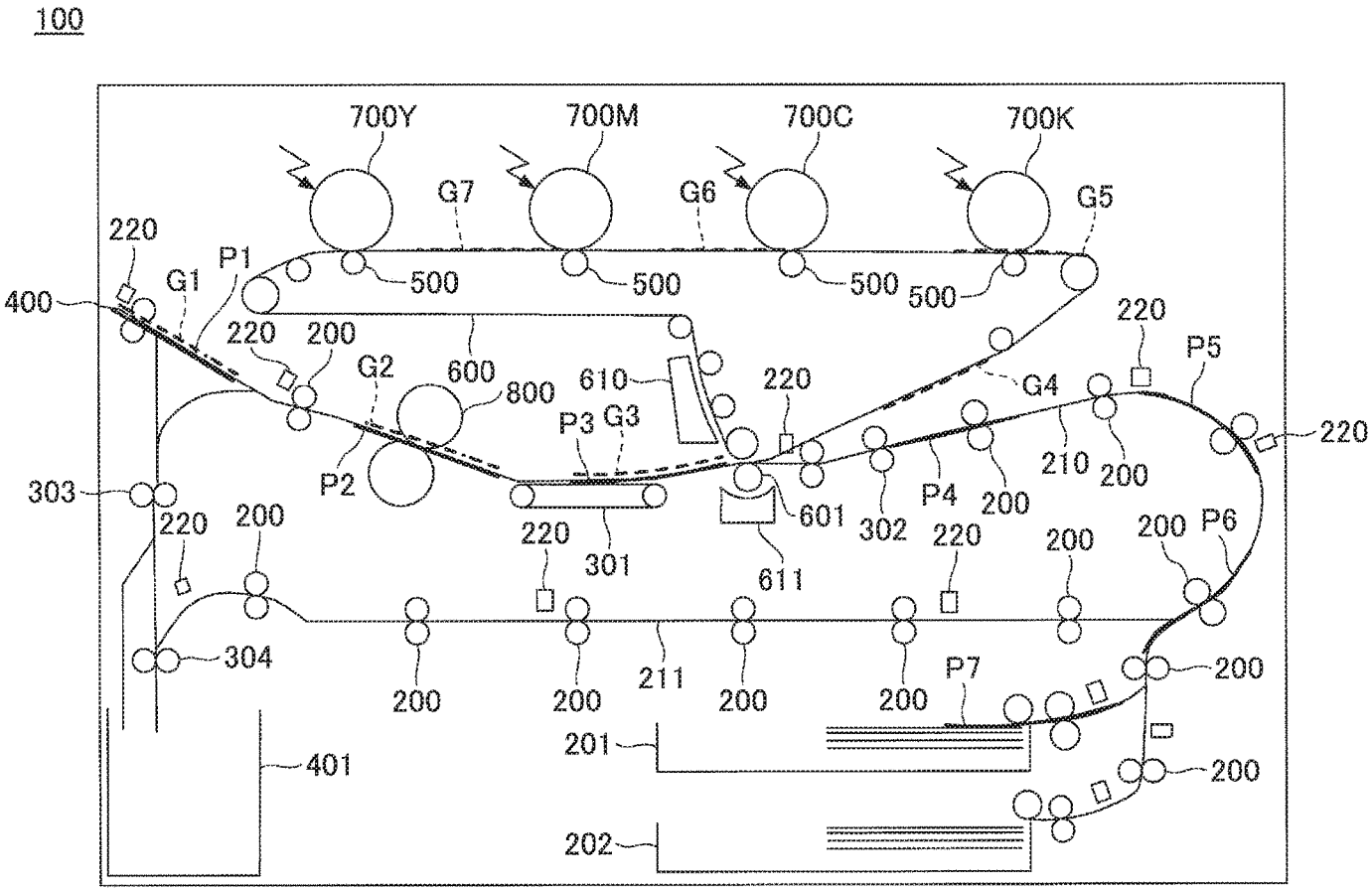
FIG. 1 is a diagram depicting an example schematic arrangement of an image forming apparatus according to the embodiment.

In the following, embodiments of the present invention will be described with reference to the accompanying drawings. In the respective drawings, the same reference numeral is assigned to the same component, and duplicate explanation will be omitted.

<Configuration of Image Forming Apparatus>

FIG. 1 is a diagram depicting an example schematic arrangement of an image forming apparatus 100 according to the embodiment.

The image forming apparatus 100 includes photoreceptors 700Y, 700M, 700C and 700K, an intermediate transfer belt 600 as an intermediate transfer body, a secondary transfer roller 601 as a transferring means and a fixing device 800, and forms a full color image on a paper sheet P, which serves as a recording medium.

Around each of the photoreceptors 700, a charging device, an optical writing device, a developing device and the like (not shown) are provided. On surfaces of the photoreceptors 700, which are rotationally driven, toner images of yellow (Y), magenta (M), cyan (C) and black (K) are formed, respectively. The toner images formed on the respective photoreceptors 700 are superposed and primarily transferred onto the intermediate transfer belt 600, which is rotationally driven by a primary transfer roller 500, to form a full color toner image.

The toner image formed on the intermediate transfer belt 600 is subsequently transferred onto the paper sheet P by the secondary transfer roller 601 at a secondary transfer position between the intermediate transfer belt 600 and the secondary transfer roller 601.

The paper sheet P is fed from a paper feeding tray 201 or a paper feeding tray 202 along a conveyance path 210 by a plurality of conveyance rollers 200, which serve as conveying means. The paper sheet P conveyed along the conveyance path 210 is conveyed to the secondary transfer position by a registration roller 302 in accordance with a timing of the secondary transfer for the full color toner image on the intermediate transfer belt 600.

For example, as shown in FIG. 1, in a case of successively forming images on seven sheets of paper sheets P1 to P7, at first, the paper sheets P1 to P7 fed from the paper feed tray 201 or 202 are sequentially conveyed along the conveyance path 210 by the conveyance rollers 200.

Onto the intermediate transfer belt 600, toner images formed on the respective photoreceptors 700 are primarily transferred, and toner images G1 to G7 to be transferred onto the paper sheets P1 to P7 respectively are formed sequentially. The toner images G1 to G7 formed on the intermediate transfer belt 600 are sequentially transferred onto the paper sheets P1 to P7 which are conveyed to the secondary transfer position. The paper sheet P on which the toner image G is transferred is conveyed to the fixing device 800, and heated and pressure is applied, and thereby the toner image G is fixed on a surface and a printed image is obtained.

In a state depicted in FIG. 1, the toner image G is fixed on the surface of the paper sheet P1 that has passed through the fixing device 800, and the printing on one side is completed. The paper sheet P2 is passing through the fixing device 800, and the toner image G2 is being fixed on the surface. The toner image G3 is transferred to the surface of the paper sheet P3 passing through the secondary transfer position, and is being conveyed toward the fixing device 800. Moreover, the paper sheets P4 to P7 are being conveyed along the conveyance path 210, and the toner images G4 to G7 to be transferred onto the paper sheets P4 to P7 are formed on the intermediate transfer belt 600.

In a case of single-side printing, the paper sheet P, on which an image is formed on one side thereof, is ejected from an ejection unit 400 to the outside of the image forming apparatus 100. In a case of double-side printing, after an image is formed on one side of the paper sheet P, is made switchback and conveyed by inverted conveyance rollers 303, 304, and conveyed along an inverted conveyance path 211 in a state where front and back are reversed. Onto the paper sheet P, front and back of which are reversed, a toner image is transferred on the other side at the secondary transfer position again. Then, the paper sheet P passes through the fixing device 800, and the image is formed on the other side. Thereafter, the paper sheet P is ejected to the outside of the image forming apparatus 100 from the ejection unit 400.

Here, toner, that has not been subsequently transferred from the intermediate transfer belt 600 to the paper sheet P at the secondary transfer position and is present on the intermediate transfer belt 600, is collected by a first cleaning unit 610. The first cleaning unit 610 includes, for example, a cleaning roller, which is separated from and arranged to be opposed to the intermediate transfer belt 600, and applies an electric voltage to the cleaning roller to collect toner on the intermediate transfer belt 600.

Due to abrasion, or the like, of the intermediate transfer belt 600, a transfer rate onto a paper sheet P may decrease, and image quality may degrade. Therefore, the first cleaning unit 610 preferably collects toner from the intermediate transfer belt 600 by a non-contact method.

Moreover, the secondary transfer roller 601 is provided with a second cleaning unit 611 that collects toner adhering on a surface of the secondary transfer roller 601. The second cleaning unit 611 causes, for example, a blade, a brush or the like to abut the secondary transfer roller 601, to collect toner adhering on the secondary transfer roller 601.

The first cleaning unit 610 and the second cleaning unit 611 may be any of the contact method and the non-contact method, if the process of collecting toner does not affect the image quality. Moreover, configuration of each of the contact method and the non-contact method is not limited to the above-described configuration as long as toner can be collected.

The conveyance path 210 and the inverted conveyance path 211 of a paper sheet P are provided with a plurality of paper sensors 220. The paper sensors 220 are, for example, optical sensors, and detect a paper sheet P conveyed on the conveyance path 210 or the inverted conveyance path 211. In a case where the paper sheet P is not detected by any of the paper sensors 220 within a predetermined timing, it is determined that an anomalous conveyance (jam) of the paper sheet P occurs on the conveyance path 210 or the inverted conveyance path 211.

The conveyance path 210 is provided with a conveyance belt 301 on which paper sheets P present on the conveyance path 210 when a jam occurs are gathered. The conveyance belt 301 is provided, in the conveyance path 210, between the secondary transfer roller 601 and the fixing device 800. Moreover, the image forming apparatus 100 is provided with a paper ejection tray 401 to which paper sheets P present on the conveyance path 210 when a jam occurs are ejected.

When it is determined that a jam occurs based on a detection result by the paper sensors 220, paper sheets P present on the conveyance path 210 are, for example, gathered on the conveyance belt 301 or ejected to the paper ejection tray 401.

(Configuration and Operation of Conveyance Belt)

Figure 2:
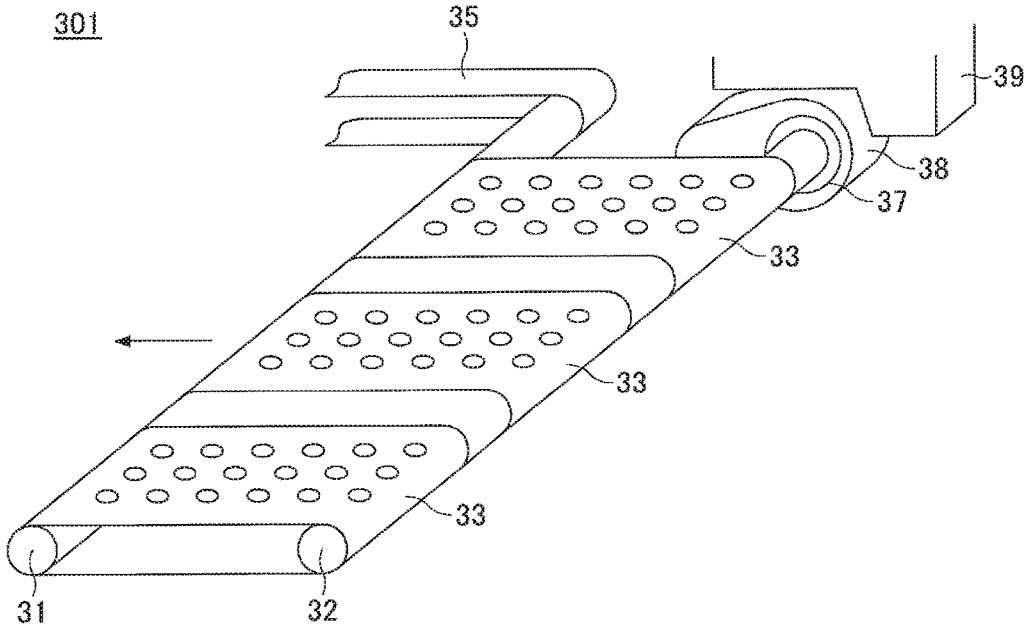
FIG. 2 is a diagram depicting an example schematic arrangement of a conveyance belt according to the embodiment.
Figure 3A:
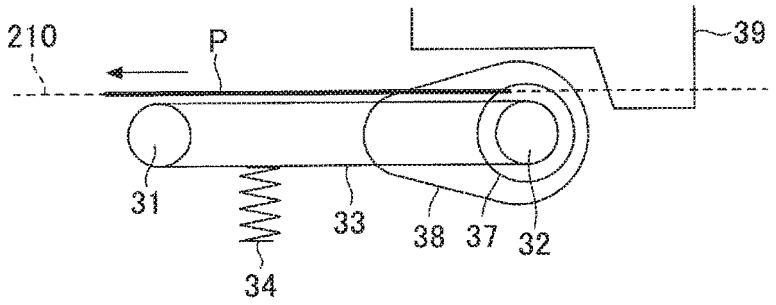
FIGS. 3A to 3C are diagrams for explaining an operation of the conveyance belt according to the embodiment.
Figure 3B:
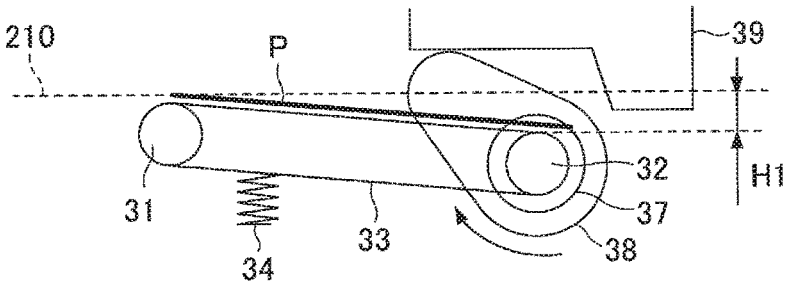
Figure 3C:
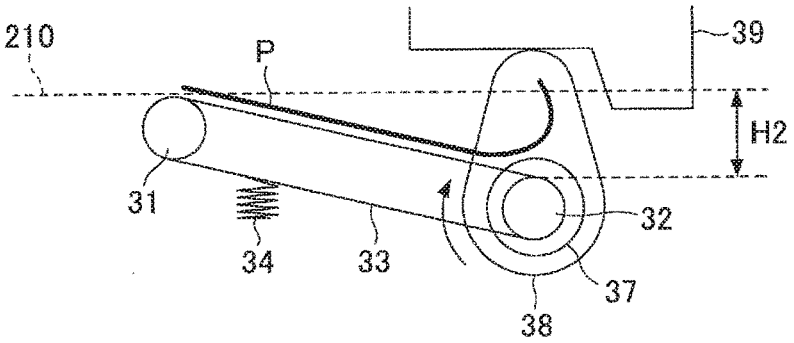

FIG. 2 is a diagram depicting an example schematic arrangement of the conveyance belt 301 according to the embodiment. Moreover, FIGS. 3A to 3C are diagrams for explaining an operation of the conveyance belt 301 according to the embodiment.

As shown in FIG. 2, the conveyance belt 301 includes a driving roller 31, a driven roller 32, which serves as a contact/separation roller, and an endless belt 33.

The driving roller 31 and the driven roller 32 are arranged rotatably, respectively, and arranged along the conveyance path 210. The driving roller 31 rotates driven by a driving belt 35 which rotates by a motor, which is not shown.

The endless belt 33 is stretched to be laid between the driving roller 31 and the driven roller 32, and rotates by a force applied from the driving roller 31. When the endless belt 33 rotates, the driven roller 32 rotates driven by the endless belt 33. The endless belt 33 rotates in a counter-clockwise direction in FIG. 2 in a case of conveying a paper sheet P, and conveys the paper sheet P in the direction indicated by an arrow. Moreover, the endless belt 33 is, as shown in FIGS. 3A to 3C, pressed toward the conveyance path 210 by a spring 34 as a biasing means.

At an end of the driven roller 32, a cam 38 is provided via a one-way clutch 37. As shown in FIG. 3A, in a case where the endless belt 33 normally rotates in a direction of conveying the paper sheet P (counter-clockwise direction in FIG. 3A), the one-way clutch 37 idly rotates and a rotational force of the driven roller 32 is not transmitted to the cam 38.

Moreover, as shown in FIG. 3B, when the endless belt 33 rotates in a clockwise direction in FIG. 3B, the rotational force of the driven roller 32 is transmitted to the cam 38 by the one-way clutch 37, and the cam 38 rotates in a direction indicated by the arrow. When the cam 38 rotates, the cam 38 abuts a fixing member 39 arranged to be fixed to the image forming apparatus 100, and the driven roller 32 is pushed downward so as to be separated from the conveyance path 210.

In the present embodiment, the cam 38 is arranged rotatably by 90 degrees from the state shown in FIG. 3A to the state shown in FIG. 3C. By rotating the endless belt 33 to rotate the cam 38 by a predetermined angle, a separation distance H between the driven roller 32 and the conveyance path 210 can be adjusted to an arbitrary length. For example, in the state shown in FIG. 3B, the separation distance between the driven roller 32 and the conveyance path 210 is H1, and in the state shown in FIG. 3C, the separation distance between the driven roller 32 and the conveyance path 210 is H2 (>H1).

For example, depending on a number of sheets of the paper sheets P gathered on the conveyance belt 301, tendency of the paper sheet P to curl, or the like, the separation distance H between the driven roller 32 and the conveyance path 210 is changed, and thereby the paper sheets P can be gathered so as to be superposed in good order on the endless belt 33. For example, in a case where the number of sheets of the paper sheets P to be gathered is great, or in a case where the paper sheet P is a paper sheet that curls easily, the separation distance H between the driven roller 32 and the conveyance path 210 is increased. Moreover, in a case where the number of sheets of the paper sheets P to be gathered is small, or in a case where the paper sheet P is a paper sheet hard to curl, the separation distance H between the driven roller 32 and the conveyance path 210 is decreased.

In this way, the position of the driven roller 32 is adjusted according to the condition such as the number of sheets of the paper sheets P to be gathered, and thereby the paper sheets P can be gathered so as to be superposed in good order on the endless belt 33. The paper sheets P are gathered so as to be superposed in good order on the endless belt 33, and thereby a user can easily remove the paper sheets P gathered on the endless belt 33 after the jam occurs.

When, after the paper sheets P are removed from the endless belt 33, the endless belt 33 is normally rotated in the paper conveyance direction, the cam 38 rotates in the counter-clockwise direction in FIG. 3A according to the biasing force from the spring 34, and the driven roller 32 returns to a paper conveyance position, as shown in FIG. 3A. The driven roller 32 approaches the conveyance path 210 and returns to the paper conveyance position, and thereby the conveyance belt 301 becomes capable of conveying the paper sheet P along the conveyance path 210 again.

Figure 4A:
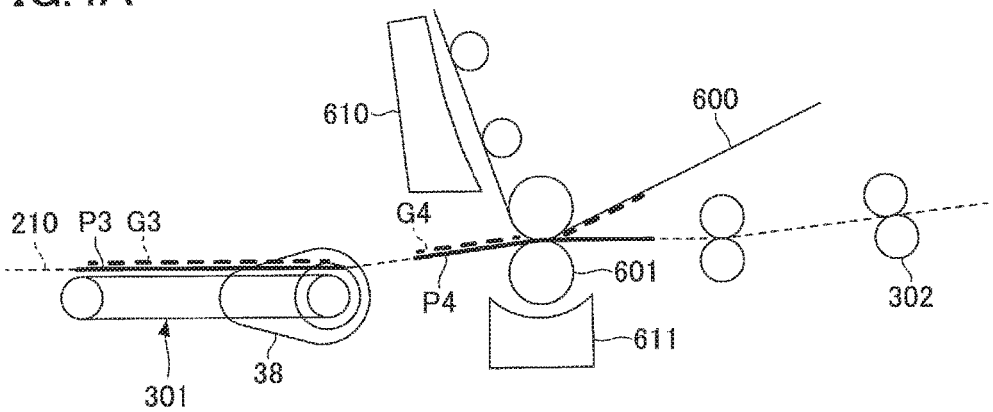
FIGS. 4A to 4C are diagrams depicting an example operation of recording media gathering on the conveyance belt according to the embodiment.
Figure 4B:
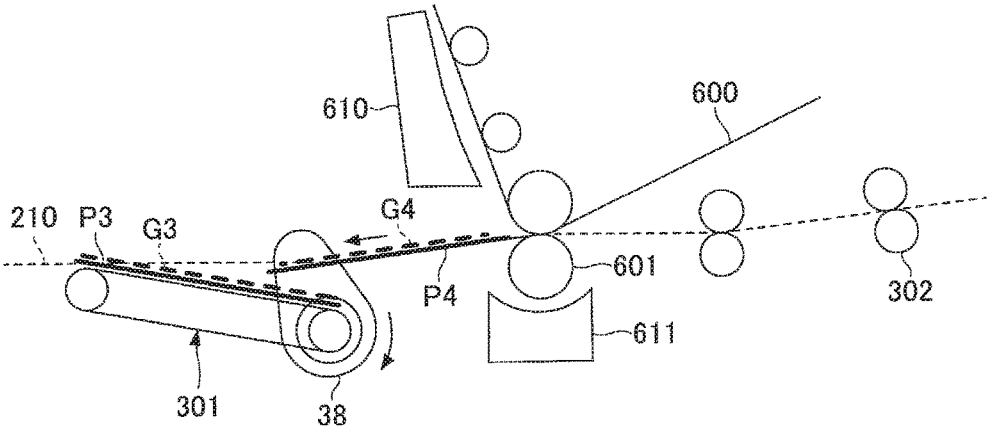
Figure 4C:
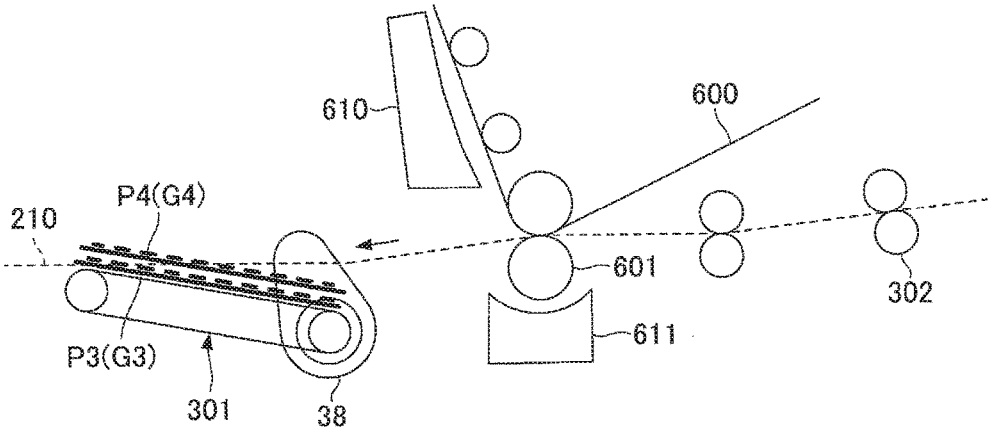

FIGS. 4A to 4C are diagrams depicting an example operation of paper sheets P gathered on the conveyance belt 301 according to the embodiment. FIGS. 4A to 4C show an operation in which the paper sheet P2 becomes jammed in the fixing device 800 from the state shown in FIG. 1, and the paper sheet P3 and the paper sheet P4 are gathered on the conveyance belt 301.

When a jam occurs downstream of the conveyance belt 301, paper sheets P present upstream of the conveyance belt 301 are gathered on the conveyance belt 301. At first, as shown in FIG. 4A, the paper sheet P3, on which toner image G3 is transferred at the secondary transfer position between the intermediate transfer belt 600 and the secondary transfer roller 601, is conveyed to the conveyance belt 301.

Next, as shown in FIG. 4B, the cam 38 rotates, the driven roller 32 is pushed downward so as to be separated from the conveyance path 210, and the conveyance belt 301 is tilted. In this state, the paper sheet P4 passing through the registration roller 302 is conveyed toward the conveyance belt 301 after a toner image G4 is transferred at the secondary transfer position.

The paper sheet P4 is, as shown in FIG. 4C, conveyed onto the conveyance belt 301 so as to be superposed on the paper sheet P3. The paper sheet P4 is conveyed in the state where the conveyance belt 301 is tilted so as to be separated from the conveyance path 210 on the upstream side, and thereby the paper sheet P4 is conveyed onto the conveyance belt 301 so as to be superposed on the paper sheet P3 without causing the front end of the paper sheet P4 to collide with a rear end of the paper sheet P3.

In this way, the paper sheets are gathered and superposed with each other without causing the front end of the paper sheet P4 to collide with the rear end of the paper sheet P3, and thereby contamination inside the apparatus due to scattering of untransferred toner is reduced, and the user can easily remove the paper sheets P.

The conveyance belt 301 includes the above-described configuration, and when a jam occurs, the paper sheets P present on upstream of the jam are gathered. The configuration of the conveyance belt 301 is not limited to the configuration depicted in the present embodiment.

Figure 5:
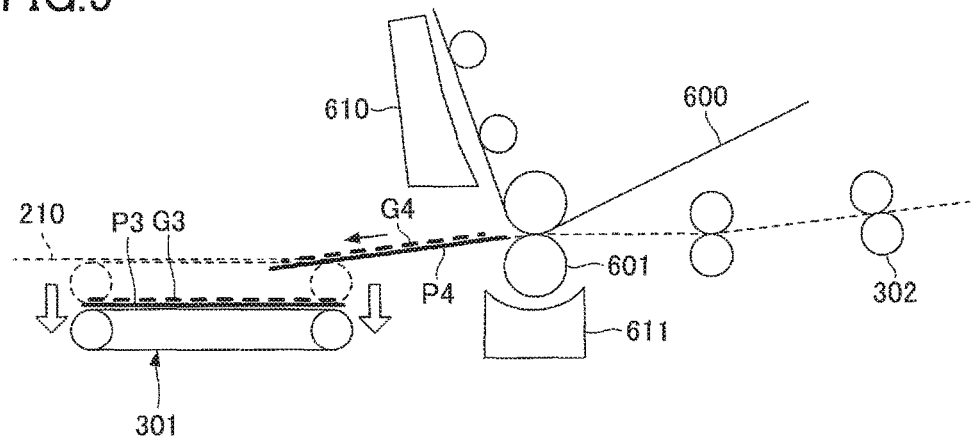
FIG. 5 is a diagram depicting a variation of the conveyance belt.

For example, the conveyance belt 301 may be arranged so that both the driving roller 31 and the driven roller 32 are capable of contacting with and separating from the conveyance path 210. In this case, as shown in FIG. 5, when the paper sheets P are gathered, both the driving roller 31 and the driven roller 32 are displaced in the direction of being separated from the conveyance path 210, and the entire conveyance belt 301 is separated from the conveyance path 210. In the same way as above, without causing a subsequent paper sheet P4 to collide with a preceding paper sheet P3, a plurality of paper sheets P present when a jam occurs can be gathered so as to be superposed in good order on the conveyance belt 301.

For example, the conveyance belt 301 may be configured by the endless belt 33 stretched over three or more rollers including one or more contact/separation rollers which are arranged so as to be capable of contacting with and separating from the conveyance path 210. Moreover, a mechanism of the contact/separation roller contacting with and separating from the conveyance path 210 is not limited to the configuration depicted in the embodiment.

The image forming apparatus 100 according to the embodiment is provided with the conveyance belt 301 as a gathering means. However, a plurality of gathering means may be provided. The gathering means may have a different configuration from the conveyance belt. Moreover, the gathering means may be provided upstream of the secondary transfer position on the conveyance path 210, or may be provided on the inverted conveyance path 211.

<Functional Configuration of Image Forming Apparatus>

Figure 6:
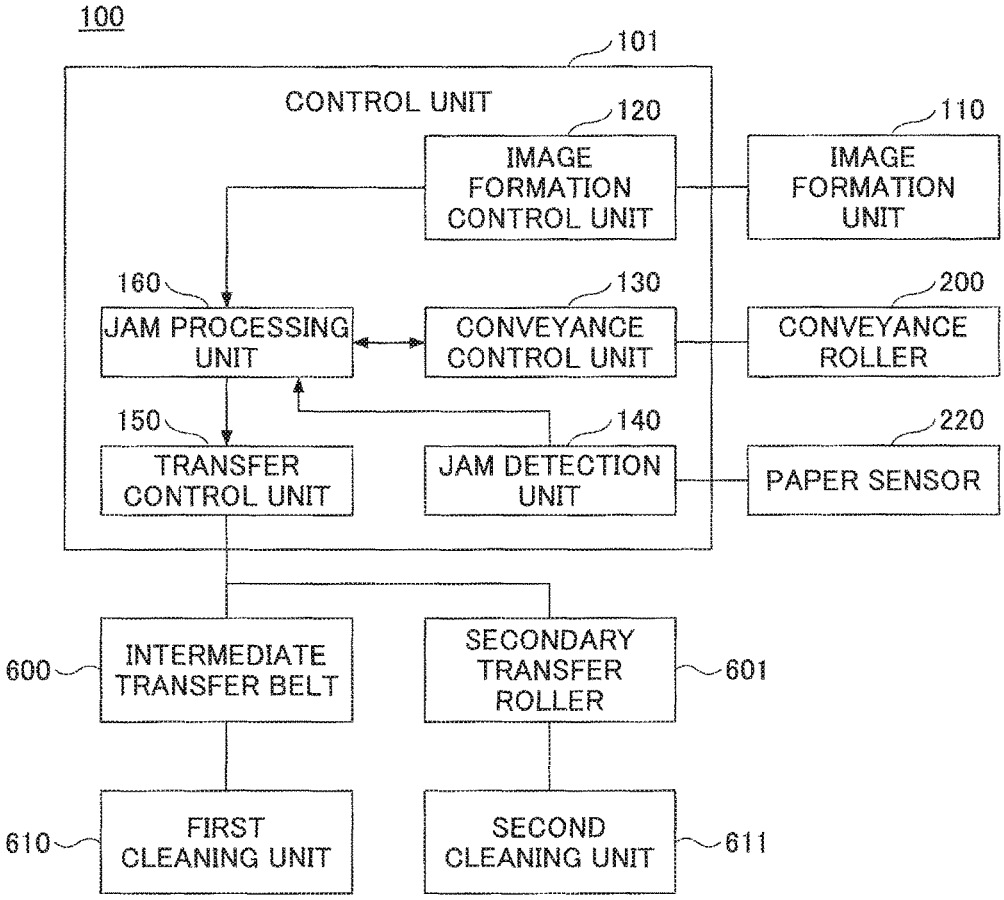
FIG. 6 is a block diagram depicting an example functional configuration of the image forming apparatus according to the embodiment.

Next, a functional configuration of the image forming apparatus 100 will be described. FIG. 6 is a block diagram depicting an example functional configuration of the image forming apparatus 100 according to the embodiment.

The image forming apparatus 100 includes, as shown in FIG. 6, a control unit 101, an image formation unit 110, a conveyance roller 200, paper sensors 220, an intermediate transfer belt 600, a first cleaning unit 610, a secondary transfer roller 601, and a second cleaning unit 611.

The control unit 101 includes an image formation control unit 120, a conveyance control unit 130, a jam detection unit 140 as a jam detection means, a transfer control unit 150 and a jam processing unit 160 as a jam processing means. Respective functions of the control unit 101 are enabled by, for example, a CPU reading out a program stored in a ROM and cooperating with a RAM to execute the program.

The image formation control unit 120 controls the image formation unit 110 including photoreceptors 700, a fixing device arranged around the photoreceptors 700 and the like, and forms toner images on surfaces of the photoreceptors 700. Moreover, the image formation control unit 120 overlays and transfers the toner images formed on the surfaces of the photoreceptors 700 onto a surface of the intermediate transfer belt 600, to form a full color toner image on the intermediate transfer belt 600.

The conveyance control unit 130 controls the conveyance roller 200, the conveyance belt 301, the registration roller 302 and the like, to convey a paper sheet P fed from the paper feeding trays 201, 202 along the conveyance path 210 or the inverted conveyance path 211.

The jam detection unit 140 detects a jam of the paper sheet P on the conveyance path 210 and the inverted conveyance path 211, based on a detection result for the paper sheet P by the paper sensors 220 arranged on the conveyance path 210 and the inverted conveyance path 211. The jam detection unit 140 determines that a jam occurs, for example, when the paper sheet P is not detected by any of the paper sensors 220 within a predetermined timing.

The transfer control unit 150 controls the intermediate transfer belt 600 and the secondary transfer roller 601, to transfer the toner image formed on the surface of the intermediate transfer belt 600 onto the paper sheet P conveyed to a secondary transfer position.

The jam processing unit 160 controls, when the jam detection unit 140 detects a jam, the conveyance roller 200, the conveyance belt 301, the intermediate transfer belt 600, the secondary transfer roller 601 and the like via the conveyance control unit 130 and the transfer control unit 150, to perform a jam processing.

<Jam Processing>

Next, a jam processing performed will be described.

(First Embodiment)

Figure 7:
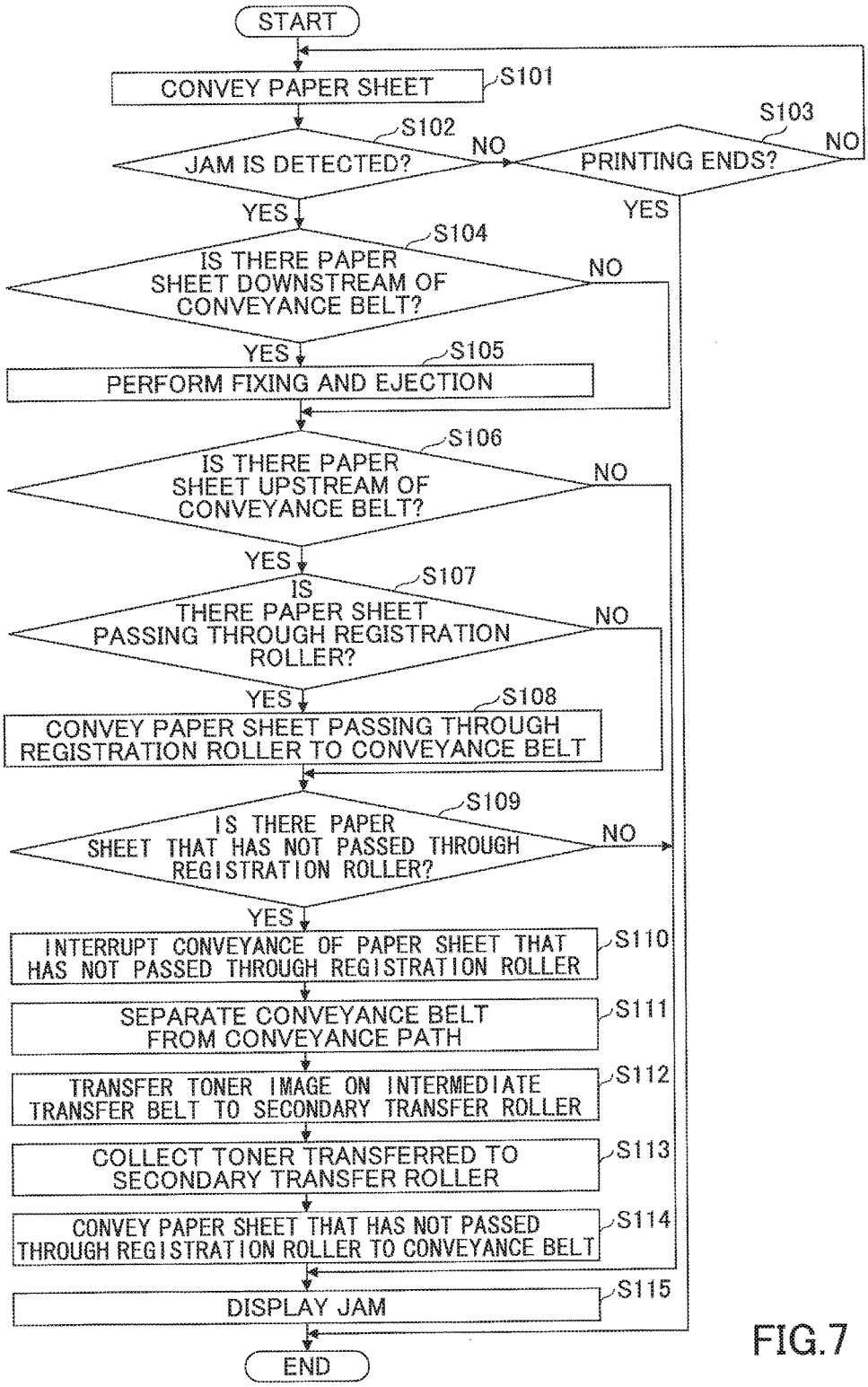
FIG. 7 is a flowchart depicting an example jam processing according to a first embodiment.

FIG. 7 is a flowchart depicting an example jam processing according to a first embodiment.

In a case of performing printing, the conveyance control unit 130 conveys a paper sheet P fed from the paper feeding tray 201 or 202 along the conveyance path 210. Onto the paper sheet P, a toner image formed on the intermediate transfer belt 600 is transferred at the secondary transfer position (step S101). The conveyance control unit 130 causes the conveyance roller 200 or the like to operate so that the paper sheet P, onto which the toner image is transferred, is further conveyed, passes through the fixing device 800, and thereafter is ejected from the ejection unit 400 or is conveyed to the inverted conveyance path 211 in the case of double-side printing.

The jam detection unit 140 determines whether a jam of the paper sheet P conveyed on the paper conveyance path 210 and the inverted conveyance path 211 occurs based on a detection result by the paper sensors 220 (step S102).

The jam detection unit 140 determines that the paper sheet P is normally conveyed in a case where passing of the paper sheet P is detected by each of the paper sensors 220 within a predetermined timing. When the paper sheet is conveyed normally (step S102: NO), the image formation control unit 120 determines whether the printing ends (step S103). When the printing does not end (step S103: no), the processes in and after step S101 are performed. Moreover, in a case where all paper sheets P on which images are formed on surfaces thereof are ejected from the ejection unit 400 and the printing ends (step S103: YES), the process ends.

The jam detection unit 140 determines that a jam occurs for the paper sheet P which is being conveyed when any of the paper sensors 220 does not detect passing of the paper sheet P within a predetermined timing. Moreover, the jam detection unit 140 perceives a position where the paper sheet P becomes jammed based on the detection result by the jam detection unit 140 when it is determined that the jam occurs. In the case where the jam is detected by the jam detection unit 140 (step S102: YES), the process proceeds to step S104.

The jam processing unit 160 acquires a conveyance position of the paper sheet P from the conveyance control unit 130 and determines whether the paper sheet P is present downstream of the conveyance belt 301 (step S104). Downstream of the conveyance belt 301 is a range on the conveyance path 210 between conveyance belt 301 and the ejection unit 400.

When the paper sheet P is present downstream of the conveyance belt 301 (step S104: YES), the jam processing unit 160 performs fixing and ejection for the paper sheet P downstream of the conveyance belt 301 (step S105). The paper sheet P, before reaching the fixing device 800, on which a toner image transferred on a surface is not fixed, is conveyed to the fixing device 800 and the toner image is fixed. Moreover, the paper sheet P passing through the fixing device 800, on which the toner image is fixed on the surface, is directly ejected from the ejection unit 400 to the outside of the apparatus or is conveyed to the inverted conveyance path 211.

The jam processing unit 160 determines whether the paper sheet P is present upstream of the conveyance belt 301 from a conveyance position of the paper sheet P acquired from the conveyance control unit 130 (step S106). Upstream of the conveyance belt 301 is a range on the conveyance path 210 between the paper feeding trays 201, 202 and the conveyance belt 301, and the inverted conveyance path 211.

When a paper sheet P is present upstream of the conveyance belt 301 (step S106: YES), the jam processing unit 160 determines whether the paper sheet P passing through the registration roller 302 is present (step S107).

When the paper sheet P passing through the registration roller 302 is present (step S107: YES), a toner image on the intermediate transfer belt 600 is transferred onto the paper sheet P passing through the registration roller 302 (step S108), and the paper sheet P on which the toner image is conveyed to the conveyance belt 301. The paper sheet P, on which the toner image is transferred, may be ejected to the outside of the apparatus from the ejection unit 400 after passing through the fixing device 800 when the paper sheet P can be conveyed to the ejection unit 400.

Next, the jam processing unit 160 determines whether a paper sheet P that has not passed through the registration roller 302 is present from a conveyance position of the paper sheet P acquired from the conveyance control unit 130 (step S109).

When the paper sheet P that has not passed through the registration roller 302 is present (step S109: YES), the jam processing unit 160 interrupts the conveyance of the paper sheet P that has not passed through the registration roller 302 (step S110).

Next, the jam processing unit 160 rotates the cam 38 to displace the driven roller 32, and thereby separates the conveyance belt 301 from the conveyance path 210 (step S111).

Subsequently, a toner image on the intermediate transfer belt 600 is transferred to the secondary transfer roller 601 (step S112). Then, the second cleaning unit 611 collects toner transferred to the secondary transfer roller 601 (step S113).

After the toner image from the intermediate transfer belt 600 is transferred to the secondary transfer roller 601, the interrupted conveyance of the paper sheet P is resumed, and the paper sheet P that has not passed through the registration roller 302 is conveyed to the conveyance belt 301 (step S114).

The jam processing unit 160 displays, for example, on a display unit of the image forming apparatus 100 that a jam has occurred (step S115), and the process ends. Moreover, the jam processing unit 160 may report to a PC of the user or the like that a jam has occurred.

As described above, according to the jam processing according to the first embodiment, for example, when a jam occurs for the paper sheet P2 in a state shown in FIG. 1, the paper sheet P1, on which the toner image G1 is fixed, is ejected from the ejection unit 400. When the paper sheet P2 cannot be conveyed, the paper sheet P2 remains at the location of the jam. When the paper sheet P2 can be conveyed, the paper sheet P2 passes through the fixing device 800 and the toner image G2 is fixed on the surface, and thereafter the paper sheet P2 is ejected from the ejection unit 400.

Moreover, the paper sheet P3 passing through the registration roller 302, in a state where the toner image G3 is transferred onto one face, is conveyed to the conveyance belt 301, or when the paper sheet P2 is ejected to the outside of the apparatus, passes through the fixing device 800 and ejected from the ejection unit 400.

The conveyance of the paper sheets P4 to P7 upstream of the registration roller 302 is interrupted when a jam is detected. Then, the toner images G4 to G7 formed on the intermediate transfer belt 600 are transferred to the secondary transfer roller 601 and collected by the second cleaning unit 611.

After toner of the images G4 to G7 on the intermediate transfer belt 600 are transferred to secondary transfer roller 601 and collected by the second cleaning unit 611, the conveyance of the paper sheets P4 to P7 is resumed and the paper sheets P4 to P7 are gathered being superposed on the conveyance belt 301.

Figure 8:
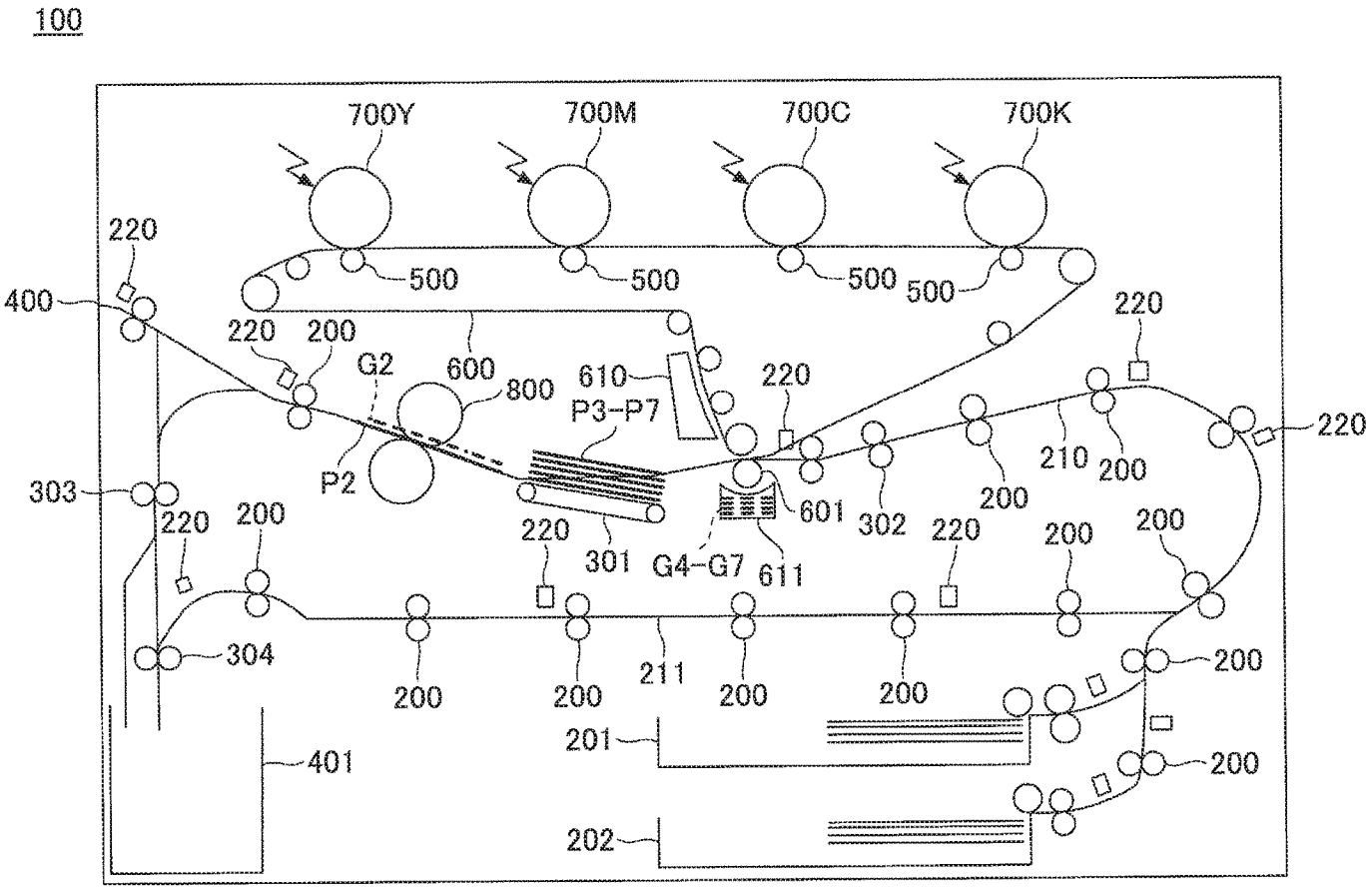
FIG. 8 is a diagram depicting an example state of the image forming apparatus after the jam processing according to the first embodiment.

FIG. 8 is a diagram depicting an example of the image forming apparatus 100 after the jam processing, when a jam occurs for the paper sheet P2 from the state shown in FIG. 1.

As shown in FIG. 8, the paper sheet P2 remains at the location of the jam, and the paper sheets P3 to P7 are conveyed to the conveyance belt 301 and gathered so as to be superposed. The toner images G4 to G7 formed on the intermediate transfer belt 600 are transferred to the secondary transfer roller 601 and collected by the second cleaning unit 611.

In this way, a toner image formed on the intermediate transfer belt 600 when a jam occurs is transferred to the secondary transfer roller 601 and collected by the second cleaning unit 611. Therefore, the first cleaning unit 601, which collects toner present on the surface of the intermediate transfer belt 600, only has to collect the toner present on the surface of the intermediate transfer belt 600, and the processing load is reduced.

Therefore, problem such as a printing failure due to a toner overflow, which occurs when the first cleaning unit 610 collects more untransferred toner than its capacity upon performing jam processing, and thus, contamination inside the apparatus and contamination of a recording medium, can be avoided.

Moreover, on the conveyance belt 301, paper sheets P conveyed upstream of the registration roller 302 when a jam occurs, are gathered in a state of blank sheets on which toner images are not transferred. Therefore, a user can remove the paper sheets P gathered on the conveyance belt 301 without get his/her hands dirty by unfixed toner that has not passed through the fixing device 800.

Furthermore, because the conveyance belt 301 is separated from the conveyance path 210 when the paper sheets P are gathered, the paper sheets P are gathered being superposed in good order on the conveyance belt 301 without scattering. Therefore, the user can remove the gathered paper sheets P easily.

In the method according to Japanese Patent No. 4909206, untransferred toner present on a secondary transfer belt when the jam occurs are collected by a cleaning means arranged around the secondary transfer belt. Here, when printing on a sheet in which a ratio of an image (hereinafter, referred to as an image area ratio) is high is performed and jams occur often, the amount of untransferred toner is more than the capacity of the cleaning means, and the toner may overflow from the cleaning means, and thereby contaminate the inside of the apparatus. Moreover, a recording medium may be contaminated by toner falling from the cleaning means during printing, and thereby a printing failure occurs.

According to the present embodiment of the present invention, an image forming apparatus is provided that can reduce a load of collecting toner by the cleaning unit arranged for the intermediate transfer body when a jam occurs.

(Second Embodiment)

Figure 9:
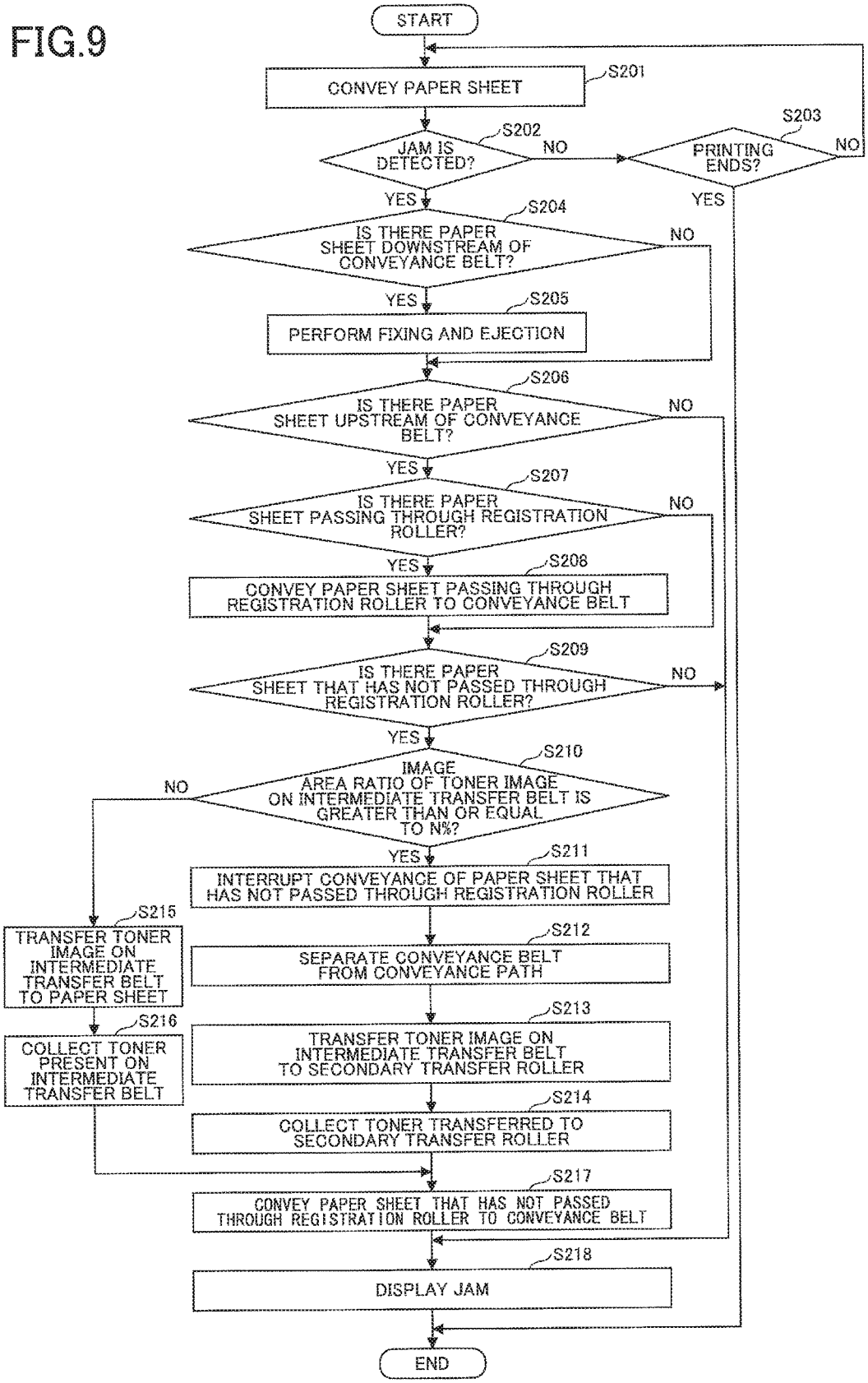
FIG. 9 is a flowchart depicting an example jam processing according to a second embodiment.

FIG. 9 is a flowchart depicting an example jam processing according to a second embodiment.

Contents of processes in steps S201 to S209 in the jam processing according to the second embodiment shown in FIG. 9 are the same as the contents of processes in steps S101 to S109 in the jam processing according to the first embodiment, and explanation thereof will not be provided.

The jam processing unit 160 acquires an image area ratio of a toner image formed on the intermediate transfer belt 600 from the image formation control unit 120 (step S210).

The image area ratio is obtained by the following formula, for example:

Image area ratio [%]=(area of toner image/area of image formation region)×100

Moreover, when a plurality of toner images to be transferred onto different paper sheets P, respectively, are formed on the intermediate transfer belt 600, the jam processing unit 160 may acquire an average value, a maximum value or a minimum value of image area ratios of the respective toner images as the image area ratio.

If the image area ratio of the toner image is N % or more (step S210: YES), the jam processing unit 160 interrupts conveyance of a paper sheet P that has not passed through the registration roller 302 (step S211). Next, the jam processing unit 160 rotates the cam 38 to displace the driven roller 32, and thereby separates the conveyance belt 301 from the conveyance path 210 (step S212).

Subsequently, a toner image on the intermediate transfer belt 600 is transferred to the secondary transfer roller 601 (step S213). Moreover, the second cleaning unit 611 collects toner transferred to the secondary transfer roller 601 (step S214).

Subsequently, the paper sheets P that has not passed through the registration roller 302 are conveyed to the conveyance belt 301 in a state of blank sheets and gathered (step S217).

If the image area ratio of the toner image is less than N % (step S211: NO), the jam processing unit 160 transfers the toner image formed on the intermediate transfer belt 600 onto a paper sheet P (step S215). Next, the first cleaning unit 610 collects untransferred toner on the intermediate transfer belt 600 (step S216).

Subsequently, paper sheets P, which are upstream of the registration roller 302 when a jam occurs, are conveyed to the conveyance belt 301, and gathered (step S217).

The threshold value N [%], with which the jam processing unit 160 compares an image area ratio, is set appropriately based on, for example, capacities of collection for toner of the first cleaning unit 610, the second cleaning unit 611 or the like.

The jam processing unit 160 displays, for example, on a display unit of the image forming apparatus 100 that a jam has occurred (step S218), and the process ends.

As described above, according to the jam processing according to the second embodiment, for example, if an image area ratio of a toner image on the intermediate transfer belt 600 is high, the toner image on the intermediate transfer belt 600 is transferred to the secondary transfer roller 601, and the second cleaning unit 611 collects untransferred toner. Moreover, when the image area ratio of the toner image on the intermediate transfer belt 600 is low, the first cleaning unit 610 collects untransferred toner.

In this way, the untransferred toner on the intermediate transfer belt 600 when the jam occurs, are collected by the second cleaning unit 611 when the image area ratio is great. Therefore, an amount of toner to be collected by the first cleaning unit 610, when the jam occurs, is reduced, and a processing load on the first cleaning unit 610 is reduced.

Therefore, a problem such as a printing failure due to a toner overflow, which occurs by the first cleaning unit 610 collecting untransferred toner that is more than its capacity upon performing jam processing, and contamination inside the apparatus and contamination of a recording medium, can be avoided.

(Third Embodiment)

Figure 10:
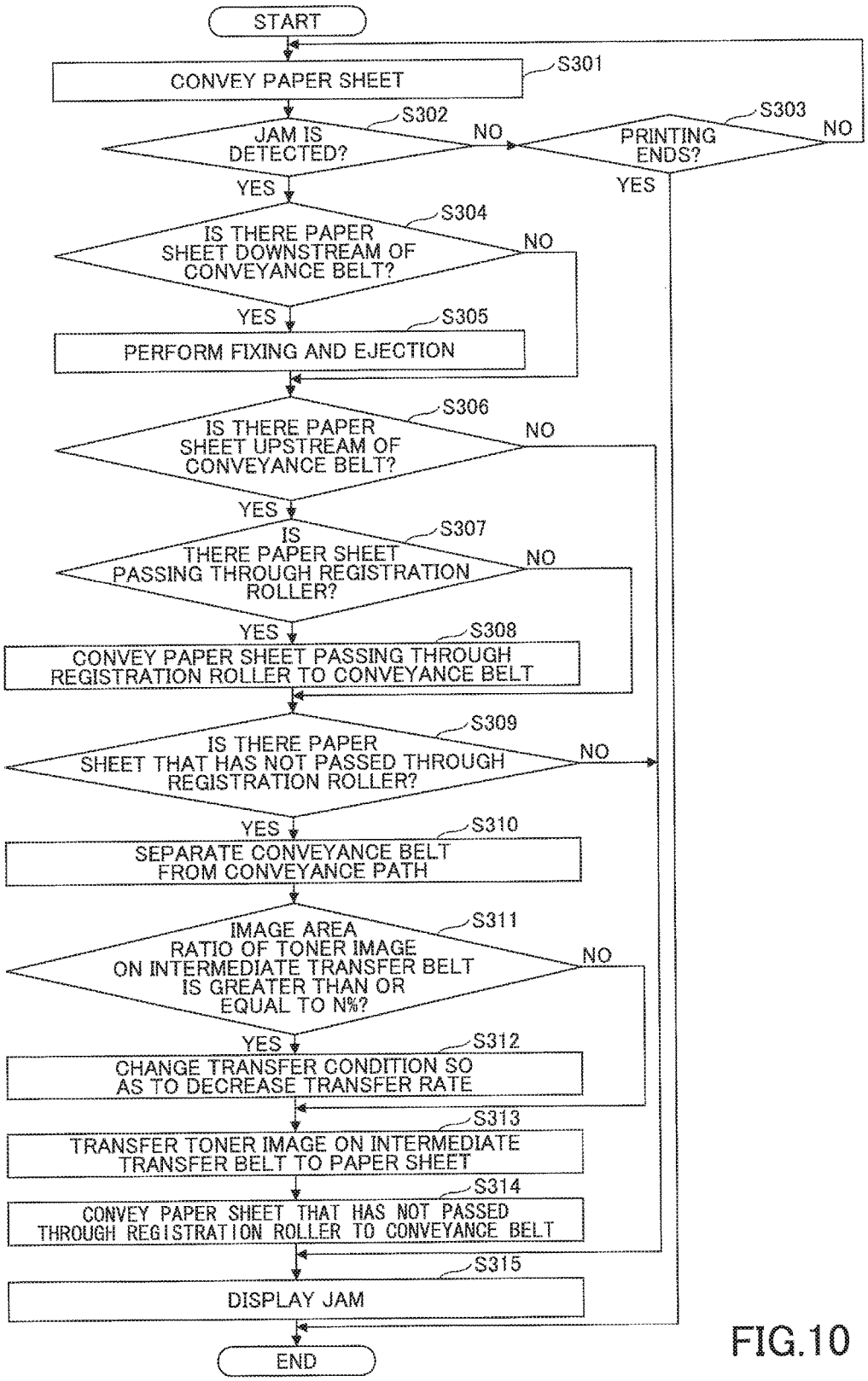
FIG. 10 is a flowchart depicting an example jam processing according to a third embodiment.

FIG. 10 is a flowchart depicting an example jam processing according to a third embodiment.

Contents of processes in steps S301 to S309 in the jam processing according to the second embodiment shown in FIG. 10 are the same as the contents of processes in steps S101 to S109 in the jam processing according to the first embodiment, and explanation thereof will not be provided.

In a case where a paper sheet P that has not passed through the registration roller 302 remains on the conveyance path 210 when a jam occurs, the jam processing unit 160 rotates the cam 38 to displace the driven roller 32, and thereby separates the conveyance belt 301 from the conveyance path 210 (step S310). Next, the jam processing unit 160 acquires an image area ratio for a toner image formed on the intermediate transfer belt 600 from the image formation control unit 120 (step S311).

If the image area ratio of the toner image is N % or more (step S311: YES), the jam processing unit 160 changes a transfer condition so that a transfer rate from the intermediate transfer belt 600 to a paper sheet P becomes lower than that upon performing printing normally (step S312). The jam processing unit 160, for example, makes a transfer electric current less than that upon performing printing normally, and thereby decreases the transfer rate T from the intermediate transfer belt 600 to the paper sheet P from a first transfer rate T1 [%] of normal time to a second transfer rate T2 (<T1).

Next, in the transfer condition, set as above, the toner image on the intermediate transfer belt 600 is transferred onto the paper sheet P (step S313). Moreover, paper sheets P, on which toner images are transferred and which are present upstream of the registration roller 302 when a jam occurs, are conveyed to the conveyance belt 301 and gathered (step S314).

The jam processing unit 160 displays, for example, on a display unit of the image forming apparatus 100 that a jam has occurred (step S315), and the process ends.

As described above, according to the jam processing according to the third embodiment, if the image area ratio for the toner image on the intermediate transfer belt 600 is high, at least a part of toner on the intermediate transfer belt 600 is transferred to the paper sheet P. Therefore, the amount of toner to be collected by the first cleaning unit 610, when a jam occurs, is reduced, and the processing load on the first cleaning unit 610 is reduced.

Therefore, a problem such as a printing failure due to a toner overflow, which occurs by the first cleaning unit 610 collecting untransferred toner that is more than its capacity upon performing jam processing, and contamination inside the apparatus and contamination of a recording medium, can be avoided.

As described above, according to the image forming apparatus 100 of the present embodiment, when a jam occurs, a processing load on the first cleaning unit 610 arranged for the intermediate transfer belt 600 for untransferred toner is reduced. Therefore, occurrence of various problems due to collection of toner in excess of the toner collection capacity of the first cleaning unit 610 when a jam occurs, is decreased.

Further, the present invention is not limited to these embodiments, but various variations and modifications may be made without departing from the scope of the present invention.

What is claimed is:

1. An image forming apparatus comprising:

an intermediate transfer body;

an image formation unit, configured to form a toner image on the intermediate transfer body;

a transfer unit, arranged opposite the intermediate transfer body, configured to transfer the toner image onto a recording medium at a secondary transfer position provided between the intermediate transfer body and the transfer unit;

a first cleaning unit configured to collect toner of the toner image formed by the image formation unit on the intermediate transfer body;

a conveyance unit configured to convey the recording medium along a conveyance path;

a gathering unit arranged on the conveyance path downstream of the secondary transfer position at a gathering position, the gathering unit being configured to gather a plurality of recording media;

a processor configured to detect a jam of the recording medium conveyed on the conveyance path based on a signal from a sensor, control the intermediate transfer body and the transfer unit to transfer residual toner not transferred onto the recording medium when the jam is detected, from the intermediate transfer body to the transfer unit, cause the gathering unit to gather the plurality of recording media present on the conveyance path upstream of the secondary transfer position when the jam is detected, and control the conveyance unit to gather a plurality of recording media present on the conveyance path to the gathering position, if the jam is detected; and a second cleaning unit configured to collect the residual toner on the transfer unit that is transferred from the intermediate transfer body.

2. The image forming apparatus according to claim 1, wherein, in a case where an image area ratio of the residual toner is greater than or equal to a predetermined value, the processor is configured to transfer the residual toner from the intermediate transfer body to the transfer unit, and cause the second cleaning unit to collect the residual toner, and wherein, in a case where the image area ratio of the residual toner is less than the predetermined value, the processor is configured to cause the first cleaning unit to collect the residual toner.

3. An image forming apparatus comprising:

an intermediate transfer body;

an image formation unit, configured to form a toner image on the intermediate transfer body;

a transfer unit, arranged opposite the intermediate transfer body, configured to transfer the toner image onto a recording medium at a secondary transfer position that is between the intermediate transfer body and the transfer unit;

a cleaning unit configured to collect toner of the toner image formed by the image formation unit on the intermediate transfer body;

a conveyance unit configured to convey the recording medium along a conveyance path;

a jam detection unit configured to detect a jam of the recording medium conveyed on the conveyance path; and a jam processing unit configured to transfer residual toner, which is not transferred onto the recording medium, when the jam is detected by the jam detection unit, from the intermediate transfer body onto the recording medium, wherein in a case where an image area ratio of the residual toner is less than a predetermined value, the jam processing unit is configured to cause the transfer unit to transfer the residual toner onto the recording medium at a first transfer rate, and wherein in a case where the image area ratio of the residual toner is greater than or equal to the predetermined value, the jam processing unit is configured to cause the transfer unit to transfer the residual toner onto the recording medium at a second transfer rate, which is less than the first transfer rate.

4. The image forming apparatus according to claim 1, wherein the gathering unit includes a plurality of rollers including a contact/ separation roller arranged capable of contacting with or separating from the conveyance path; and a conveyance belt stretched over the plurality of rollers, the conveyance belt being configured to be rotationally driven to convey the plurality of recording media along the conveyance path, and wherein the processor is configured to separate the contact/separation roller from the conveyance path, when the processor causes the gathering unit to gather the plurality of recording media.

5. The image forming apparatus according to claim 4, wherein the contact/separation roller is provided so as to have a variable separation distance to the conveyance path.

6. The image forming apparatus according to claim 4, wherein the gathering unit is coupled to the contact/ separation roller, the contact/separation roller is driven by the conveyance belt to rotate, via a one-way clutch, wherein the gathering unit includes a cam that rotates with the contact/separation roller, to abut on a fixed member, when the conveyance belt reverse rotates in a direction opposite a direction for conveying the recording medium, and wherein the processor is configured to cause the conveyance belt to reverse rotate, to cause the cam to abut on the fixed member and thereby to separate the contact/ separation roller from the conveyance path, when the processor causes the gathering unit to gather the plurality of recording media.

7. The image forming apparatus according to claim 1, wherein the processor is configured to eject the recording medium, if the recording medium is on the conveyance path downstream of the secondary transfer position when the jam is detected, to an outside of the image forming apparatus.

8. The image forming apparatus according to claim 2, wherein the gathering unit includes a plurality of rollers including a contact/ separation roller arranged capable of contacting with or separating from the conveyance path; and a conveyance belt stretched over the plurality of rollers, the conveyance belt being configured to be rotationally driven to convey the plurality of recording media along the conveyance path, and wherein the processor is configured to separate the contact/ separation roller from the conveyance path, when the processor causes the gathering unit to gather the plurality of recording media.

9. The image forming apparatus according to claim 8, wherein the contact/separation roller is provided so as to have a variable separation distance to the conveyance path.

10. The image forming apparatus according to claim 8, wherein the gathering unit is coupled to the contact/ separation roller, the contact/separation roller being driven by the conveyance belt to rotate, via a one-way clutch, wherein the gathering unit includes a cam that rotates with the contact/separation roller, to abut on a fixed member, when the conveyance belt reverse rotates in a direction opposite a direction for conveying the recording medium, and wherein the processor is configured to cause the conveyance belt to reverse rotate, to cause the cam to abut on the fixed member and thereby to separate the contact/ separation roller from the conveyance path, when the processor causes the gathering unit to gather the plurality of recording media.

11. The image forming apparatus according to claim 3 further comprising a gathering unit arranged on the conveyance path downstream of the secondary transfer position, the gathering unit being configured to gather a plurality of recording media, wherein the jam processing unit is configured to cause the gathering unit to gather recording media present on the conveyance path upstream of the secondary transfer position when the jam is detected.

12. The image forming apparatus according to claim 11, wherein the gathering unit includes a plurality of rollers including a contact/ separation roller arranged capable of contacting with or separating from the conveyance path; and a conveyance belt stretched over the plurality of rollers, the conveyance belt being configured to be rotationally driven to convey the recording media along the conveyance path, and wherein the jam processing unit is configured to separate the contact/ separation roller from the conveyance path, when the jam processing unit causes the gathering unit to gather the recording media.

13. The image forming apparatus according to claim 12, wherein the contact/separation roller is provided so as to have a variable separation distance to the conveyance path.

14. The image forming apparatus according to claim 12, wherein the gathering unit is coupled to the contact/ separation roller, which is driven by the conveyance belt to rotate, via a one-way clutch, wherein the gathering unit includes a cam that rotates with the contact/separation roller, to abut on a fixed member, when the conveyance belt reverse rotates in a direction opposite a direction for conveying a recording medium, and wherein the jam processing unit is configured to cause the conveyance belt to reverse rotate, to cause the cam to abut on the fixed member and thereby to separate the contact/separation roller from the conveyance path, when the jam processing unit causes the gathering unit to gather the recording media.

15. The image forming apparatus according to claim 3, wherein the jam processing unit is configured to eject a recording medium, which is on the conveyance path downstream of the secondary transfer position when the jam is detected, to an outside of the image forming apparatus.

16. An image forming method comprising:

detecting a jam of a recording medium conveyed on a conveyance path;

transferring residual toner, the residual toner not being transferred onto the recording medium at a secondary transfer position when the jam is detected, from an intermediate transfer body, a toner image being formed on the intermediate transfer body, to a transfer unit—arranged opposite the intermediate transfer body and configured to transfer the toner image onto the recording medium;

collecting the residual toner transferred to the transfer unit;

conveying a plurality of recording media present on the conveyance path to a gathering position downstream from the secondary transfer position, in response to the detecting; and gathering, by a gathering unit at the gathering position downstream from the secondary transfer position, a plurality of recording media present on the conveyance path upstream of the secondary transfer position when the jam is detected.

* * * * *